US012305502B2

(12) United States Patent
Leach et al.

(10) Patent No.: US 12,305,502 B2
(45) **Date of Patent: *May 20, 2025**

(54) METHODS FOR ASSESSING THE RELIABILITY OF HYDRAULICALLY-ACTUATED DEVICES AND RELATED SYSTEMS

(71) Applicant: Transocean Innovation Labs Ltd., George Town (KY)

(72) Inventors: Andrew Leach, Houston, TX (US); Matthew Boike, Houston, TX (US); Luis Rafael Pereira, Katy, TX (US)

(73) Assignee: TRANSOCEAN INNOVATION LABS LTD., Grany Cayman (KY)

( * ) Notice: Subject to any disclaimer, the term of this patent is extended or adjusted under 35 U.S.C. 154(b) by 913 days.

This patent is subject to a terminal disclaimer.

(21) Appl. No.: 17/479,354

(22) Filed: Sep. 20, 2021

(65) Prior Publication Data

US 2022/0003112 A1 Jan. 6, 2022

Related U.S. Application Data

(63) Continuation-in-part of application No. 17/195,196, filed on Mar. 8, 2021, now Pat. No. 12,037,891, (Continued)

(51) Int. Cl.
*E21B 47/09* (2012.01)
*E21B 33/035* (2006.01)
(Continued)

(52) U.S. Cl.
CPC ..... *E21B 47/09* (2013.01); *E21B 33/0355* (2013.01); *E21B 33/038* (2013.01);
(Continued)

(58) Field of Classification Search
CPC ..... E21B 47/09; E21B 33/0355
See application file for complete search history.

(56) References Cited

U.S. PATENT DOCUMENTS 5,021,181 A 6/1991 Kanamori
8,893,803 B1 * 11/2014 Lugo ..... E21B 43/013 166/347
(Continued)

FOREIGN PATENT DOCUMENTS

CN 202108810 U 1/2012
CN 103429911 A 12/2013
(Continued)

OTHER PUBLICATIONS

Communication Pursuant to Article 94(3) EPC for European Patent Application No. 21 169 599.4-1002, issued Dec. 7, 2022.
(Continued)

*Primary Examiner* — Clayton E. LaBalle
*Assistant Examiner* — Diana Hancock
(74) *Attorney, Agent, or Firm* — Panitch Schwarze Belisario & Nadel LLP

(57) ABSTRACT

This disclosure includes methods for testing hydraulically-actuated devices and related systems. Some hydraulically-actuated devices have a housing defining an interior volume and a piston disposed within the interior volume and dividing the interior volume into a first chamber and a second chamber, where the piston is movable relative to the housing between a maximum first position and a maximum second position in response to pressure differentials between the first and second chambers. Some methods include: (1) moving the piston to the first position by varying pressure within at least one of the first and second chambers such that pressure within the second chamber is higher than pressure within the first chamber; and (2) while the piston remains in the first position: (a) reducing pressure within the second
(Continued)

chamber and/or increasing pressure within the first chamber; and (b) increasing pressure within the second chamber and/or decreasing pressure within the first chamber.

22 Claims, 7 Drawing Sheets

Related U.S. Application Data which is a continuation of application No. 15/610,170, filed on May 31, 2017, now Pat. No. 10,941,648.

(60) Provisional application No. 62/343,446, filed on May 31, 2016.

(51) Int. Cl.

| | |
|---|---|
| ***E21B 33/038*** | (2006.01) |
| ***E21B 33/06*** | (2006.01) |
| ***E21B 33/064*** | (2006.01) |
| ***E21B 47/07*** | (2012.01) |
| *E21B 33/08* | (2006.01) |

(52) U.S. Cl.

CPC ..... *E21B 33/062* (2013.01); *E21B 33/064* (2013.01); *E21B 33/085* (2013.01); *E21B 47/07* (2020.05)

(56) References Cited

U.S. PATENT DOCUMENTS

| | | | | |
|---|---|---|---|---|
| 10,941,648 | B2 * | 3/2021 | Leach | E21B 33/0355 |
| 11,105,173 | B2 * | 8/2021 | Leach | E21B 21/10 |
| 12,037,891 | B2 * | 7/2024 | Leach | E21B 34/16 |
| 2002/0023532 | A1 | 2/2002 | Porter | |
| 2003/0000693 | A1 | 1/2003 | Couren et al. | |
| 2007/0286745 | A1 * | 12/2007 | Chance | B01F 35/714 417/397 |
| 2010/0223923 | A1 | 9/2010 | Grassi | |
| 2012/0073670 | A1 | 3/2012 | Lymberopoulos | |
| 2013/0276516 | A1 * | 10/2013 | Tabor | G01M 99/008 73/37 |
| 2013/0333894 | A1 * | 12/2013 | Geiger | E21B 34/04 166/336 |
| 2014/0047271 | A1 | 2/2014 | Gray et al. | |
| 2014/0131049 | A1 * | 5/2014 | Bourgeau | E21B 33/064 166/363 |
| 2014/0182271 | A1 | 7/2014 | Jannot et al. | |
| 2015/0114660 | A1 * | 4/2015 | Kotrla | F16L 41/021 285/133.21 |
| 2015/0337950 | A1 | 11/2015 | Knoth et al. | |
| 2016/0084271 | A1 | 3/2016 | Gomm et al. | |
| 2016/0215608 | A1 * | 7/2016 | Jaffrey | E21B 33/06 |
| 2016/0327447 | A1 * | 11/2016 | Hilpert | G01M 3/2876 |
| 2017/0362929 | A1 | 12/2017 | Leach et al. | |
| 2022/0003112 | A1 | 1/2022 | Leach et al. | |

FOREIGN PATENT DOCUMENTS

| | | | |
|---|---|---|---|
| CN | 103939421 | A | 7/2014 |
| CN | 104093995 | A | 10/2014 |
| CN | 104395615 | A | 3/2015 |
| CN | 104632766 | A | 5/2015 |

OTHER PUBLICATIONS

Office Action issued Oct. 4, 2023 in U.S. Appl. No. 17/195,196.
International Search Report and Written Opinion in International Application No. PCT/US2017/035234 dated Aug. 14, 2017.
Office Action issued by the Chinese Patent Office for Application No. 201780047551.5, dated Dec. 17, 2019, 23 pages Including English translation.
Extended European Search Report issued by the European Patent Office for Application No. 17807404.3, dated Jan. 29, 2020, 7 pages.
Written Opinion issued by the Singapore Patent Office for Application No. 11201810698S, dated Apr. 7, 2020, 8 pages.
Second Office Action issued by the Chinese Patent Office for Application No. 201780047551.5, dated Sep. 29, 2020, 9 pages including English translation.
Office Action issued Mar. 7, 2022 in Australian Application No. 2017273551.
Office Action issued Nov. 4, 2021 in Brazilian Application No. 112018074767-0.
Extended European Search Report issued Mar. 4, 2022 in European Application No. 21169599.4.
Communication Pursuant to Article 94(3) EPC for European Patent Application No. 21 169 599.4-1002, issued Jun. 29, 2023.
Non-Final Office Action issued by The United States Patent and Trademark Office for U.S. Appl. No. 15/610,170, dated Sep. 20, 2018, 10 pages.
Interview Summary record issued by The United States Patent and Trademark Office for U.S. Appl. No. 15/610,170, dated Feb. 25, 2019, 3 pages.
Final Office Action issued by The United States Patent and Trademark Office for U.S. Appl. No. 15/610,170, dated Jun. 13, 2019, 16 pages.
Office Action issued by the Singapore Patent Office for Application No. 11201810698S,dated Jun. 25, 2021, 5 pages.

* cited by examiner

METHODS FOR ASSESSING THE RELIABILITY OF HYDRAULICALLY-ACTUATED DEVICES AND RELATED SYSTEMS

CROSS-REFERENCES TO RELATED APPLICATIONS

This application is a continuation-in-part of U.S. patent application Ser. No. 17/195,196, filed Mar. 8, 2021, entitled "Methods for Assessing the Reliability of Hydraulically-Actuated Devices and Related Systems," which is a continuation of U.S. patent application Ser. No. 15/610,170, filed May 31, 2017, entitled "Methods for Assessing the Reliability of Hydraulically-Actuated Devices and Related Systems," now U.S. Pat. No. 10,941,648, which claims priority to and the benefit of U.S. Provisional Application No. 62/343,446, filed on May 31, 2016 and entitled "Methods for Assessing the Reliability of Hydraulically-Actuated Devices and Related Systems," the contents of each of which is incorporated herein by reference in its entirety.

BACKGROUND

1. Field of Invention

The present invention relates generally to hydraulically-actuated devices, such as hydraulically-actuated devices of blowout preventers, and more specifically, but not by way of limitation, to methods for assessing the reliability of such hydraulically-actuated devices and related systems.

2. Description of Related Art

A blowout preventer (BOP) is a mechanical device, usually installed redundantly in a stack, used to seal, control, and/or monitor an oil and gas well. A BOP typically includes or is associated with a number of components, such as, for example, rams, annulars, accumulators, test valves, kill and/or choke lines and/or valves, riser connectors, hydraulic connectors, and/or the like, many of which may be hydraulically-actuated.

Due at least in part to the magnitude of harm that may result from failure to actuate a BOP, safety or back-up systems are often implemented, such as, for example, deadman and autoshear systems. However, such systems are typically integrated with an existing BOP such that, if the BOP fails, the systems may be unavailable.

Probability of failure on demand (PFD), which typically increases over time, is a measure of the probability that a given system will fail when it is desired to function that system. Testing is an effective way to reduce PFD; however testing of existing BOPs and/or safety or back-up systems may be difficult. For example, to traditionally test an existing BOP and/or safety or back-up system, full functioning of the BOP and/or safety or back-up system may be required, in some instances, necessitating time- and cost-intensive measures, such as the removal of any objects, such as drill pipe, disposed within the wellbore, the disconnection of the lower marine riser package, and/or the like.

Examples of safety or back-up blowout prevention systems are disclosed in (1) U.S. Pat. No. 8,881,829 and U.S. Pub. Nos.: (2) 2012/0001100 and (3) 2012/0085543.

SUMMARY

Some embodiments of the present disclosure can provide for testing of a system that includes a hydraulically-actuated device having a piston movable between maximum first and second positions, in some instances, without requiring full actuation of the hydraulically-actuated device (e.g., movement of the piston to each of the first and second positions), via, for example, being configured for and/or including moving the piston to the first position and, while the piston remains in the first position: (1) reducing a force that acts to urge the piston toward the first position; and (2) increasing a force that acts to urge the piston toward the first position. Such testing may be performed automatically and/or manually to decrease a PFD of a system.

Some embodiments of the present systems are configured as a safety and/or back-up blowout prevention system having increased availability, reliability, fault-tolerance, retrofitability, and/or the like, via, for example, including a hydraulically-actuated device and a (e.g., dedicated) hydraulic pressure source for actuating the hydraulically-actuated device, a (e.g., dedicated) processor, communications channel, and/or the like for controlling the hydraulically-actuated device, and/or the like (e.g., such that the system is independent of other blowout prevention system(s), integration, and thus fault transfer, between the system and other blowout prevention system(s) is minimized, and/or the like).

Some embodiments of the present systems comprise: a hydraulically-actuated device including a housing defining an interior volume and a piston disposed within the interior volume such that the piston divides the interior volume into a first chamber and a second chamber, where the piston is movable relative to the housing to a maximum first position in response to pressure within the second chamber being greater than pressure within the first chamber and to a maximum second position in response to pressure within the first chamber being greater than pressure within the second chamber, a hydraulic pressure source configured to vary pressure within at least one of the first chamber and the second chamber, and a processor configured to control the pressure source to, while the piston is in the first position: (a) decrease pressure within the second chamber and/or increase pressure within the first chamber; and (b) increase pressure within the second chamber and/or decrease pressure within the first chamber. In some systems, the processor is configured to control the pressure source to move the piston to the first position. In some systems, the processor is configured to control the pressure source to move the piston to the second position. In some systems, the hydraulically-actuated device comprises a blowout preventer (BOP).

In some systems, the pressure source comprises a pump. In some systems, the pump comprises a bidirectional pump, and the system is configured such that: rotation of the pump in a first direction decreases pressure within the second chamber and/or increases pressure within the first chamber; and rotation of the pump in a second direction that is opposite the first direction increases pressure within the second chamber and/or decreases pressure within the first chamber.

Some systems comprise a motor coupled to the pump and configured to actuate the pump. In some systems, the motor comprises an electric motor. Some systems comprise a battery coupled to the motor and configured to supply electrical power to the motor. Some systems comprise an electric motor speed controller coupled to the motor and configured to control the motor.

Some systems comprise one or more sensors configured to capture data indicative of: a pressure of hydraulic fluid within the system; a flowrate of hydraulic fluid within the system; a temperature of hydraulic fluid within the system; and/or a position of the piston relative to the housing. Some systems comprise one or more sensors configured to capture data indicative of a speed of the pump. Some systems comprise one or more sensors configured to capture data indicative of: a speed of the motor; a torque output by the motor; and/or and a power output by the motor. Some systems comprise one or more sensors configured to capture data indicative of a voltage supplied to the motor and/or a current supplied to the motor.

Some systems comprise one or more sensors configured to capture data indicative of one or more parameter values, including a pressure of hydraulic fluid within the system, a flowrate of hydraulic fluid within the system, a temperature of hydraulic fluid within the system, and/or a position of the piston relative to the housing. In some systems, the one or more parameter values includes a speed of the pump. In some systems, the one or more parameter values includes a speed of the motor; a torque output by the motor; and/or a power output by the motor. In some systems, the one or more parameter values includes a voltage supplied to the motor and/or a current supplied to the motor.

In some systems, the processor is configured to compare at least one of the one or more parameter values indicated in data captured by the one or more sensors to an expected parameter value. In some systems, the processor is configured to determine if a difference between the parameter value indicated in data captured by the one or more sensors and the expected parameter value exceeds a threshold.

Some systems comprise a reservoir in fluid communication with the pressure source. Some systems comprise a remotely-operated underwater vehicle (ROV) interface in fluid communication with the hydraulically-actuated device.

Some embodiments of the present methods comprise coupling an embodiment of the present systems to a BOP stack.

Some embodiments of the present methods for testing a hydraulically-actuated device having a housing defining an interior volume and a piston disposed within the interior volume such that the piston divides the interior volume into a first chamber and a second chamber, where the piston is movable relative to the housing to a maximum first position in response to pressure within the second chamber being higher than pressure within the first chamber and to a maximum second position in response to pressure within the first chamber being higher than pressure within the second chamber, comprise: (1) moving the piston to the first position by varying pressure within at least one of the first chamber and the second chamber such that pressure within the second chamber is higher than pressure within the first chamber; and (2) while the piston remains in the first position: (a) reducing pressure within the second chamber and/or increasing pressure within the first chamber; and (b) increasing pressure within the second chamber and/or decreasing pressure within the first chamber. In some methods, steps (1) and (2) are performed using a bidirectional hydraulic pump. In some methods, the hydraulically-actuated device is coupled to a BOP stack.

Some methods comprise repeating step (2). Some methods comprise: (3) moving the piston to the second position by varying pressure within at least one of the first chamber and the second chamber such that pressure within the first chamber is higher than pressure within the second chamber. Some methods comprise repeating steps (1) and (2).

Some methods comprise capturing, with one or more sensors, data indicative of one or more parameter values, including: a pressure of hydraulic fluid within the hydraulically-actuated device, a flowrate of hydraulic fluid within the hydraulically-actuated device, and/or a temperature of hydraulic fluid within the hydraulically-actuated device.

In some methods, varying, increasing, and/or reducing pressure within the first chamber and/or varying, increasing, and/or reducing pressure within the second chamber is performed by actuating a pump. In some methods, actuating the pump comprises actuating a motor that is coupled to the pump. In some methods, the motor comprises an electric motor.

In some methods, the one or more parameter values includes a speed of the pump. In some methods, the one or more parameter values includes: a speed of the motor; a torque output by the motor; and/or a power output by the motor. In some methods, the one or more parameter values includes a voltage supplied to the motor and/or a current supplied to the motor.

Some methods comprise comparing at least one of the one or more parameter values indicated in data captured by the one or more sensors to an expected parameter value. Some methods comprise determining if a difference between the parameter value indicated in data captured by the one or more sensors and the expected parameter value exceeds a threshold.

In some methods, the hydraulically-actuated device contains a hydraulic fluid. In some methods, the hydraulic fluid comprises an oil-based fluid, sea water, desalinated water, treated water, and/or water-glycol. In some methods, the hydraulic fluid comprises water-glycol.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the term "substantially" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/have/contain—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION

Figure 1A:
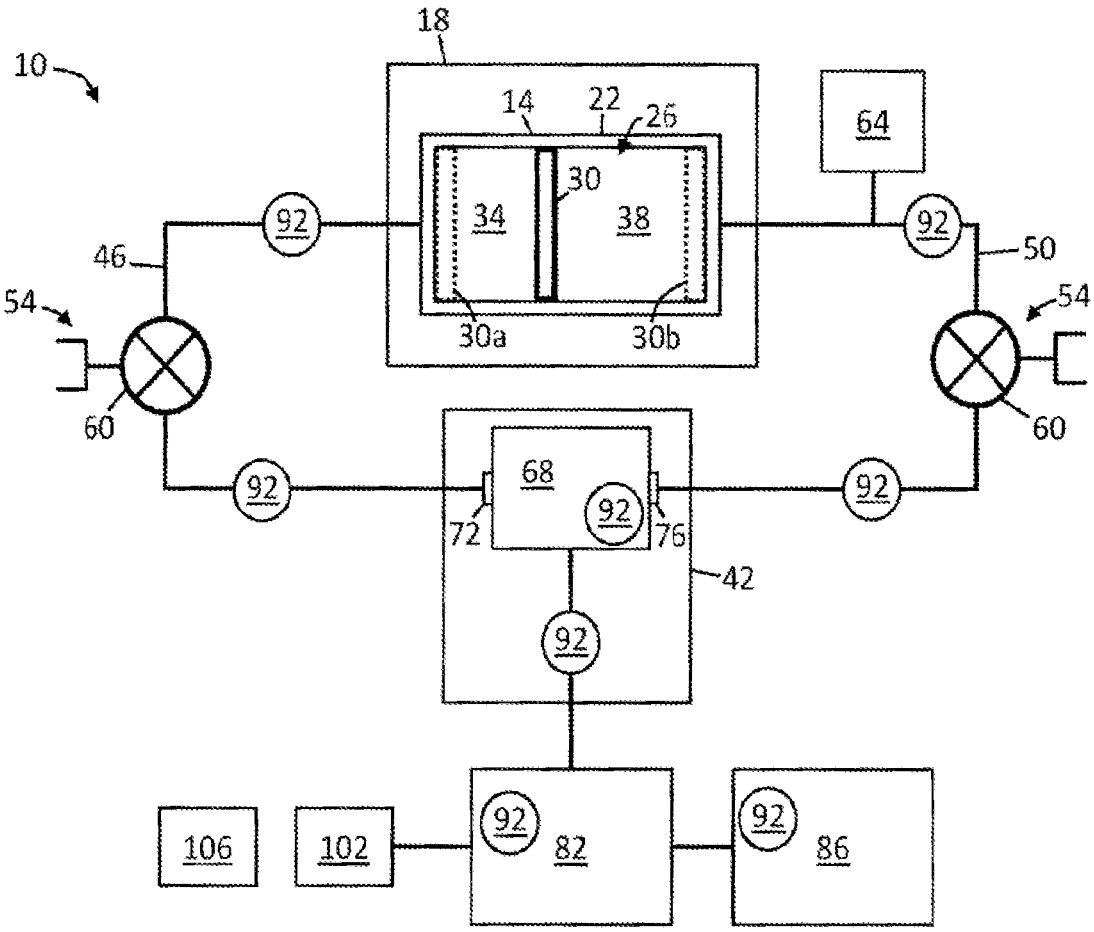
FIG. 1A is a schematic of one embodiment of the present systems, according to an embodiment.

Referring now to the drawings, and more particularly to FIG. 1A, shown therein and designated by the reference numeral 10 is one embodiment of the present systems. In the embodiment shown, a system 10 includes a hydraulically-actuatable device 14. In this embodiment, hydraulically-actuatable device 14 is a component of a BOP 18 (e.g., a ram- or annular-type BOP). In other embodiments, a hydraulically-actuatable device (e.g., 14) may be a component of any suitable device, such as, for example, an accumulator, test valve, failsafe valve, kill and/or choke line and/or valve, riser joint, hydraulic connector, and/or the like.

In the depicted embodiment, hydraulically-actuatable device 14 comprises a housing 22 defining an interior volume 26. As shown, hydraulically-actuatable device 14 includes a piston 30 disposed within interior volume 26 such that the piston divides the interior volume into a first chamber 34 and a second chamber 38. In this embodiment, piston 30, in response to pressures within first chamber 34 and second chamber 38, is movable relative to housing 22 between a maximum first position (e.g., shown with phantom lines 30*a*) and a maximum second position (e.g., shown with phantom lines 30*b*). For example, in the depicted embodiment, piston 30 may be moved toward the first position in response to pressure within second chamber 38 being greater than pressure within first chamber 34, and the piston may be moved toward the second position in response to pressure within the first chamber being greater than pressure within the second chamber. A piston (e.g., 30) may be in a maximum position relative to a housing (e.g., 22) when the piston is at an end-of-stroke position beyond which the piston cannot move relative to the housing (e.g., due to physical interference between the piston and the housing) or at any one of a range of positions that are proximate to the end-of-stroke position (e.g., including positions that are within 1, 2, 3, 4, 5, 6, 7, 8, 9, or 10% of the total stroke of the piston of the end-of-stroke position). In some embodiments (e.g., 10), a piston (e.g., 30) of a hydraulically-actuated device (e.g., 14) may be coupled to one or more rams of a BOP (e.g., 18) such that, for example, when the piston is in one of a maximum first position (e.g., 30*a*) and a maximum second position (e.g., 30*b*), the one or more rams are in an open position, and, when the piston is in the other of the first position and the second position, the one or more rams are in a closed position (e.g., some embodiments of the present systems may be used to close and seal a wellbore).

In the embodiment shown, system 10 includes a pressure source 42 (examples of which are provided below) configured to vary pressure within at least one of first chamber 34 and second chamber 38. To illustrate, in this embodiment, pressure source 42 is in fluid communication with first chamber 34 via a first communication path 46 and in fluid communication with second chamber 38 via a second communication path 50. Such communication path(s) (e.g., 46, 50, and/or the like) may include rigid and/or flexible conduit(s), which may be coupled to a pressure source (e.g., 42) and/or a hydraulically-actuated device (e.g., 14) in any suitable fashion, such as, for example, via stab(s), port(s), and/or the like. Hydraulic fluid for use in the present systems can comprise any suitable hydraulic fluid, such as, for example: an oil-based fluid, sea water, desalinated water, treated water, water-glycol, and/or the like.

In the depicted embodiment, system 10 includes one or more interfaces 54, each of which may include a valve 60, configured to provide control of and/or access to hydraulic fluid within system 10 from outside of the system (e.g., control of fluid communication through a communication path 46, 50, and/or the like, access to provide and/or remove hydraulic fluid to and/or from the system, and/or the like). Such interface(s) (e.g., 54) may be operable by a remotely-operated underwater vehicle. Such valve(s) (e.g., 60), whether or not a component of an interface (e.g., 54), may be used direct hydraulic fluid out of system 10 to, for example, decrease pressure within first chamber 34 and/or second chamber 38.

In the embodiment shown, system 10 comprises a fluid reservoir 64 (which may include one or more fluid reservoirs) configured to store and/or receive hydraulic fluid such that, for example, the fluid reservoir may facilitate the system in compensating for a loss of hydraulic fluid (e.g., due to leaks), an excess of hydraulic fluid, and/or the like. In some embodiments, hydraulic fluid may be directed (e.g., using one or more valves) to a fluid reservoir (e.g., 64) to decrease a pressure within a first chamber (e.g., 34) and/or a second chamber (e.g., 38) of a hydraulically-actuated device (e.g., 14). In some embodiments, a fluid reservoir (e.g., 64) may be configured to receive hydraulic fluid from an above-sea fluid source (e.g., via a rigid conduit and/or hot line). In some embodiments, a fluid reservoir (e.g., 64) may comprise an accumulator, which may facilitate a reduction in hydraulic fluid flow rate and/or pressure spikes within a system (e.g., 10) and/or provide pressurized hydraulic fluid in addition to or in lieu of pressurized hydraulic fluid provided by a pressure source (e.g., 42).

In this embodiment, pressure source 42 comprises a pump 68 (which may include one or more pumps) configured to provide hydraulic fluid to hydraulically-actuated device 14 to actuate the hydraulically-actuated device. Some hydraulically-actuated devices (e.g., 14) may, for effective and/or desirable operation, require hydraulic fluid at a flow rate of between 3 gallons per minute (gpm) and 130 gpm and at a pressure of between 500 pounds per square inch gauge (psig) and 5,000 psig. In embodiments (e.g., 10) including such a hydraulically-actuated device, a pump (e.g., 68) may be configured to output hydraulic fluid at such flow rates and pressures (e.g., the pump alone may be capable of providing hydraulic fluid at a sufficient flow rate and pressure to effectively and/or desirably operate the hydraulically-actuated device). A pump (e.g., 68) of the present systems (e.g., 10) may comprise any suitable pump, such as, for example, a positive displacement pump (e.g., a piston pump, such as, for example, an axial piston pump, radial piston pump, duplex, triplex, quintuplex, or the like piston/plunger pump, diaphragm pump, gear pump, vane pump, screw pump, gerotor pump, and/or the like), velocity pump (e.g., a centrifugal pump, and/or the like), over-center pump, switched-mode pump, unidirectional pump, bi-directional pump, and/or the like.

In the depicted embodiment, pump 68 is configured to actuate hydraulically-actuated device 14 by selectively pressurizing first chamber 34 and second chamber 38 of the hydraulically-actuated device. For example, in the embodiment shown, pump 68 comprises a bi-directional pump. To illustrate, pump 68 may include a first port 72 in fluid communication with first chamber 34 and a second port 76 in fluid communication with second chamber 38. When pump 68 is used to pressurize first chamber 34, first port 72 may be characterized as an outlet and second port 76 may be characterized as an inlet. Conversely, when pump 68 is used to pressurize second chamber 38, first port 72 may be characterized as an inlet and second port 76 may be characterized as an outlet.

More particularly, in this embodiment, pump 68 is configured such that rotation of the pump in a first direction urges fluid toward first chamber 34, thereby increasing pressure within the first chamber, and/or urges fluid away from (e.g., out of) second chamber 38, thereby decreasing pressure within the second chamber (e.g., causing piston 30 to be moved toward or maintained in the second position). Similarly, in the depicted embodiment, pump 68 is configured such that rotation of the pump in a second direction urges fluid toward second chamber 38, thereby increasing pressure within the second chamber, and/or urges fluid away from (e.g., out of) first chamber 34, thereby decreasing pressure within the first chamber (e.g., causing piston 30 to be moved toward or maintained in the first position). Some embodiments of the present systems in which a pump (e.g., 68) is not bi-directional may nevertheless be configured such that the pump can selectively pressurize a first chamber (e.g., 34) and a second chamber (e.g., 38) of a hydraulically-actuated device (e.g., via valve(s) disposed between the pump and the hydraulically-actuated device).

In the embodiment shown, system 10 comprises a motor 82 (which may include one or more motors) configured to actuate pump 68 (e.g., rotate the pump in the first and second directions). In the embodiment shown, motor 82 is electrically actuated; however, in other embodiments, a motor (e.g., 82) may be hydraulically-actuated. In embodiments (e.g., 10) comprising an electric motor (e.g., 82), the motor may comprise any suitable electric motor, such as, for example, a synchronous alternating current (AC) motor, asynchronous AC motor, brushed direct current (DC) motor, brushless DC motor, permanent magnet DC motor, and/or the like.

In this embodiment, system 10 comprises a controller 102 (which may include one or more controllers) configured to be coupled to motor 82 and to control (e.g., activate, deactivate, change or set a rotational speed of, change or set of a direction of, and/or the like) the motor. In the depicted embodiment, controller 102 comprises an electric motor speed controller, such as, for example, a variable speed drive; however, in other embodiments, a controller (e.g., 102) may comprise any suitable controller that is capable of controlling a motor.

In the embodiment shown, system 10 comprises a battery 86 (which may include one or more batteries). In this embodiment, battery 86 is configured to provide electrical power to motor 82. In some embodiments (e.g., 10), a battery (e.g., 86) may be configured to provide electrical power to a motor (e.g., 82) sufficient to actuate a hydraulically-actuated device (e.g., 14) using a pump (e.g., 68) coupled to the motor, without requiring electrical power from an above-sea power source. A battery (e.g., 86) of the present systems (e.g., 10) can comprise any suitable battery, such as, for example, a lithium-ion battery, nickel-metal hydride battery, nickel-cadmium battery, lead-acid battery, and/or the like. A battery (e.g., 86) may be less susceptible to effectiveness losses at increased pressures than other energy storage devices (e.g., accumulators). A battery (e.g., 86) may also occupy a smaller volume and/or have a lower weight than other energy storage devices (e.g., accumulators). Thus, batteries may be efficiently adapted to provide at least a portion of an energy necessary to, for example, perform emergency functions associated with a BOP (e.g., autoshear functions, deadman functions, and/or the like).

In the depicted embodiment, system 10 includes one or more sensors 92. Sensor(s) (e.g., 92) of the present systems (e.g., 10) can comprise any suitable sensor, such as, for example, a pressure sensor (e.g., a piezoelectric pressure sensor, strain gauge, and/or the like), flow sensor (e.g., a turbine, ultrasonic, Coriolis, and/or the like flow sensor, a flow sensor configured to determine or approximate a flow rate based, at least in part, on data indicative of pressure, and/or the like), temperature sensor (e.g., a thermocouple, resistance temperature detector, and/or the like), position sensor (e.g., a Hall effect sensor, potentiometer, and/or the like), proximity sensor, acoustic sensor, and/or the like. By way of example, in the embodiment shown, sensor(s) 92 may be configured to capture data indicative of parameters such as pressure, flow rate, temperature, and/or the like of hydraulic fluid within system 10 (e.g., within pump 68, hydraulically-actuated device 14, first communication path 46, second communication path 50, fluid reservoir 64, and/or the like), a position, velocity, and/or acceleration of piston 30 relative to housing 22, a (e.g., rotational) speed of motor 82 and/or the pump, a torque output by the motor, a voltage supplied to the motor (e.g., by battery 86), a current supplied to the motor (e.g., by the battery), and/or the like. Data captured by sensor(s) 92 may be transmitted to controller 102, processor 106, an above-sea interface, and/or the like. In some embodiments, a system (e.g., 10) may include a memory configured to store data captured by sensor(s) (e.g., 92).

In this embodiment, system 10 includes a processor 106 configured to control pump 68 to move piston 30 relative to housing 22. For example, in the depicted embodiment, processor 106 may transmit commands to controller 102 to actuate motor 82 to rotate pump 68 (e.g., in the first direction), thereby increasing pressure within first chamber 34 and/or decreasing pressure within second chamber 38 and causing piston 30 to move toward or be maintained in the second position. Similarly, processor 106 may transmit commands to controller 102 to actuate motor 82 to rotate pump 68 (e.g., in the second direction), thereby increasing pressure within second chamber 38 and/or decreasing pressure within first chamber 34 and causing piston 30 to move toward or be maintained in the first position. In the depicted embodiment, control of pump 68 by processor 106 may be facilitated by data captured by sensor(s) 92. For example, processor 106 may receive data captured by sensor(s) 92 and adjust a speed and/or direction of pump 68 until a speed and/or direction of the pump, a hydraulic fluid flow rate and/or pressure within system 10, a position of piston 30 relative to housing 22, and/or the like, as indicated in data captured by the sensor(s), meets a target value. In some embodiments, a processor (e.g., 106) may be configured to communicate with an above-sea interface, to, for example, send and/or receive data, commands, signals, and/or the like. In some embodiments, function(s) described herein for a processor (e.g., 106) may be performed by a controller (e.g., 102) and/or function(s) described herein for a controller (e.g., 102) may be performed by a processor (e.g., 106). In some embodiments, a processor (e.g., 106) and a controller (e.g., 102) may be the same component. As used herein, "processor" encompasses a programmable logic controller.

In a system (e.g., 10) where a hydraulically-actuated device (e.g., 14) is a component of a BOP (e.g., 18), the system may be configured to function as a safety and/or back-up blowout prevention system. For example, a processor (e.g., 106) of the system may be configured to actuate the hydraulically-actuated device to close the wellbore in response to a command received from an above-sea interface (e.g., via a dedicated communication channel, acoustic interface, and/or the like), a signal from a traditional autoshear, deadman, and/or the like system, and/or the like. For further example, the system may have sensor(s) (e.g., 92) including a sensor (e.g., a proximity sensor, such as, for example, an electromagnetic-, light-, or sound-based proximity sensor) configured to detect disconnection of the lower marine riser package from the BOP stack, and the processor, based at least in part on data captured by the sensor, may actuate the hydraulically-actuated device to close the wellbore. For yet further example, the processor may be configured to detect a loss of communication with the surface, upon which the processor may actuate the hydraulically-actuated device to close the wellbore.

Figure 1B:
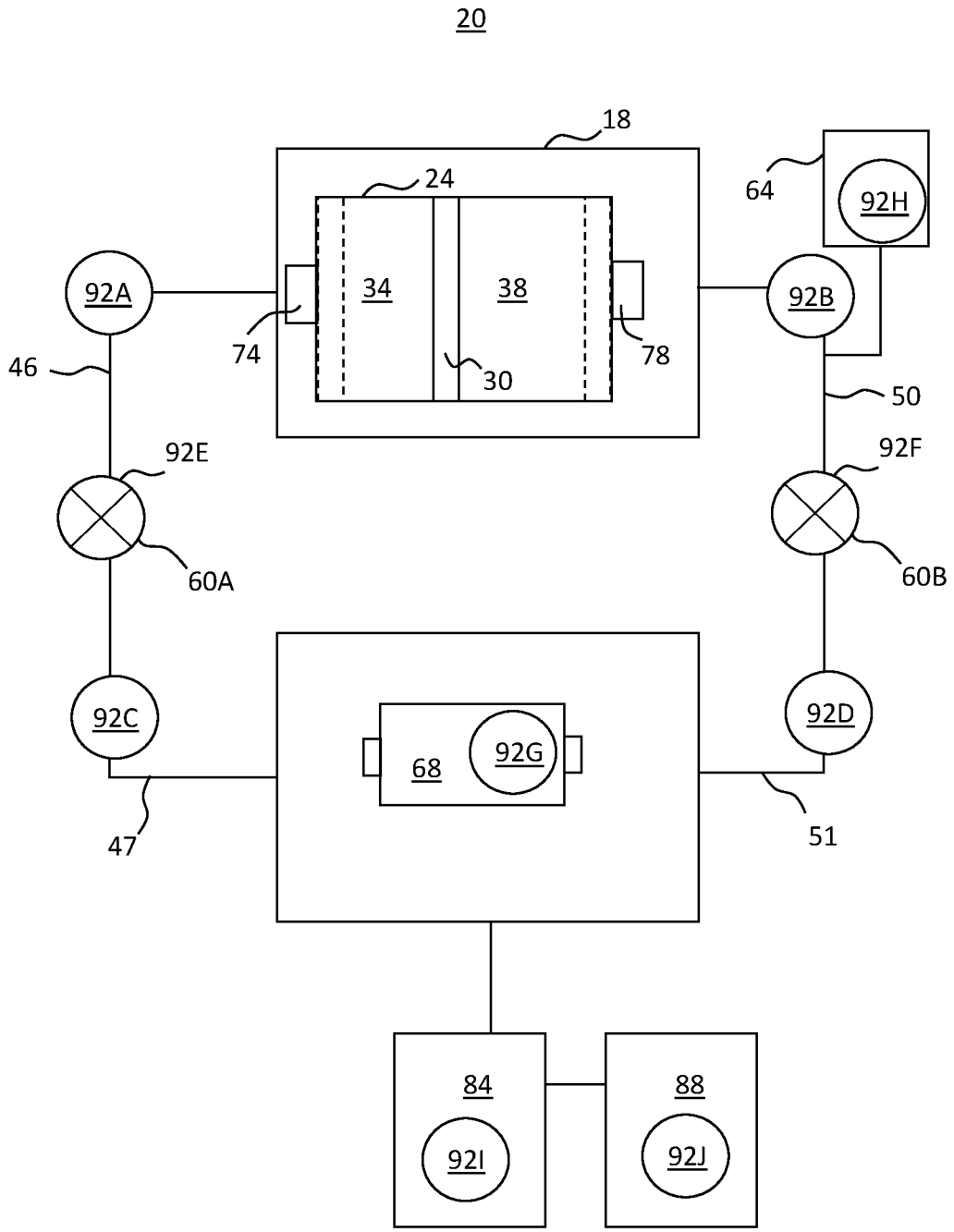
FIG. 1B is a schematic of a system containing a hydraulically-actuated device, according to an embodiment.

FIG. 1B shows another embodiment of a system 20 that includes a hydraulically-actuated device. System 20 includes components that are structurally and/or functionally similar to components of system 10. System 20 differs from system 10 in that system 20 includes sensors 92A-92J for observing various parameters of system 10 that may be used to infer about pressures within first chamber 34 and/or second chamber 38. Additionally, hydraulic-actuated device 24 of system 20 includes components that are structurally and/or functionally similar to components of hydraulic-actuated device 14 of system 10. hydraulic-actuated device 24 differs from corresponding device 14 in that it also includes ports 74 and 78. As shown in FIG. 1B, sensors 92A-92J are located outside of hydraulically-actuated device 24 (e.g., physically separate from but fluidly and/or operably coupled to hydraulically-actuated device). In some implementations, sensors 92A-92J may be coupled to an outside surface of hydraulically-actuated device 24, and/or other associated devices within the system but physically separated from the hydraulically-actuated device 24. Sensors 92A-92J are configured to measure at least one parameter associated with system 20 to determine changes in the pressure within first chamber 34 or within second chamber 38 during a selected period of time to detect a leak within hydraulically-actuated device 24. In the embodiment shown in FIG. 1B, sensors 92A-92J are used as a proxy to determine a state of a hydraulically-actuated device, such as first chamber 34 and/or second chamber 38. As shown in FIG. 1B, hydraulically-actuated device 24 includes ports 74 and 78 for respective chambers 34 and 38. Ports 74 and 78 may include associated valves allowing hydraulic fluid in and out of chambers 34 and 38. In some cases, chambers 34 and 38 may have device fluid that is different from the hydraulic fluid of conduits 46 and 50, and ports 74 and 78 may include associated pistons for separating the device fluid from the hydraulic fluid.

In some implementations, sensor 92A may be configured to measure a pressure of hydraulic fluid within conduit 46 connected to first chamber 34. Alternatively, or additionally, sensor 92A may be configured to measure a flow rate of hydraulic fluid through conduit 46 (for cases when hydraulic fluid in conduit 46 is the same as the device fluids in chamber 34). In some cases, sensor 92A may be configured to measure other characteristics of hydraulic fluid such as a temperature, viscosity or density of the hydraulic fluid within conduit 46. Additionally, or alternatively, sensor 92B may be configured to measure a pressure of hydraulic fluid within conduit 50 and/or flow rate of hydraulic fluid within conduit 50 (or other characteristics of the hydraulic fluid as discussed above). In some cases, ports 74 and 78 may be configured to pass hydraulic fluid at a target flow rate in and out of respective chambers 34 and 38 based on a pressure difference across these ports, thus allowing for determining pressure inside chambers 34 and 38 based on the hydraulic fluid flow rate and pressures determined by sensors 94A and 94B. In various implementations, the amount of hydraulic fluid (e.g., a hydraulic fluid flow rate) passing through ports 74 and 78 may be controlled via a suitable control system. For example, when ports 74 and 78 are valves, the control system may be configured to open and close these valves to control hydraulic fluid flow rate to respective chambers 34 and 38.

In various implementations of the embodiment shown in FIG. 1B, pressures within chambers 34 and 38 may be monitored (or determined) based on monitoring parameters measured by sensors 92A-92J related to operation of various components/devices of system 20. In an example implementation, various parameters of valves 60A and 60B, pump 68, motor 82, or any other suitable components (e.g., fluid reservoir 64 or charge of battery 86) may be monitored to determine pressures within chambers 34 and 38.

In various cases, parameters of components/devices of system 20 are monitored by suitable sensors 92A-92J. As described above, sensors 92A and 92B may monitor pressure within respective conduits 46 and 50, and/or may monitor flow rate of hydraulic fluid in those conduits. Additionally, sensor 92H may monitor pressure within fluid reservoir 64. Further, sensor 92H may determine amount of hydraulic fluid stored in reservoir 64. Sensors 92E and 92F may be configured to monitor pressure drop across respective valves 60A and 60B. Additionally, sensors 92E and 92F may determine flow rate of hydraulic fluid across valves 60A and 60B (e.g., determine whether valves 60A and 60B are open or close). Further sensors 92C and 92D may determine pressure in conduits 47 and 51 and/or flow rates in these conduits.

Other sensors may be also used to obtain information that can be used to infer pressures within chambers 34 and 38. For example, sensor 92G may be used to determine performance characteristics of pump 68. For instance, when pump 68 is a centrifugal pump, a pump rate of revolution may be obtained by sensor 92G and used for determining flow rate of hydraulic fluid within conduit 47. In some cases, a time change of the flow rate of hydraulic fluid in conduit 47 may be determined by sensor 92G (for example, when pump 68 is a reciprocating plunger pump). It should be noted that pump 68 may be any suitable pump (e.g., a positive displacement pump, such as rotary type, reciprocating type, or linear type, an impulse pump, a velocity pump, a gravity pump, a valveless pump, and the like), and a suitable sensor 92G may be used to determine performance characteristics of pump 68 (e.g., determine velocity of various components of pump 68, forces or pressures on various components of pump 68, orientation and position of various components of pump 68, flow rate of various fluids within pump 68, pressures of various fluids within pump 68, and the like).

Additionally, or alternatively, time flow characteristics of hydraulic fluid within conduits 46-51 (or pressures within these conduits) may be determined via associated sensors 92A-92D. Further, performance of pump 68 may be determined by sensor 921 associated with motor 82. For example, sensor 921 may determine power used by motor 82, voltage needed for motor 82 (in case motor 82 is an electric motor), rotational speed of motor 82, and the like. Additionally, a power source 86 (e.g., a battery) for motor 82 (or a power line supplied from a generator to motor 82) may include an associated sensor 92J for measuring an amount of power supplied to motor 82 (or an amount of energy remaining in power source 86, such as the amount of electrical energy).

It should be appreciated that data from any, some, or all of sensors 92A-92J may be used in any suitable combination to determine indirectly either pressures within chambers 34 and 38 and/or changes in pressure within at least one of these chambers. For example, when absolute values of pressures within chambers 34 and 38 may not be determined, at least pressure changes within a first chamber 34 and/or a second chamber 38 may be determined for evaluating a presence of leaks within one or both of these chambers. For example, if a flow rate of hydraulic fluid through port 74 is proportional to a pressure drop between chamber 34 and conduit 46, then an increase in a flow rate of hydraulic fluid through port 74 may be used to determine a pressure drop within chamber 34, provided that pressure within conduit 46 is known (e.g., constant). In various cases, pressure within conduit 46 is directly related to operation of valve 60A and performance of pump 68, thus data associated with valve 60A and pump 68 may be used instead (or in conjunction with) data obtained by sensor 92A. Similarly, pressure within conduit 50 is directly related to operation of valve 60B and performance of pump 68, thus data associated with valve 60B and pump 68 may be used instead (or in conjunction with) data obtained by sensor 92B.

Figure 1C:
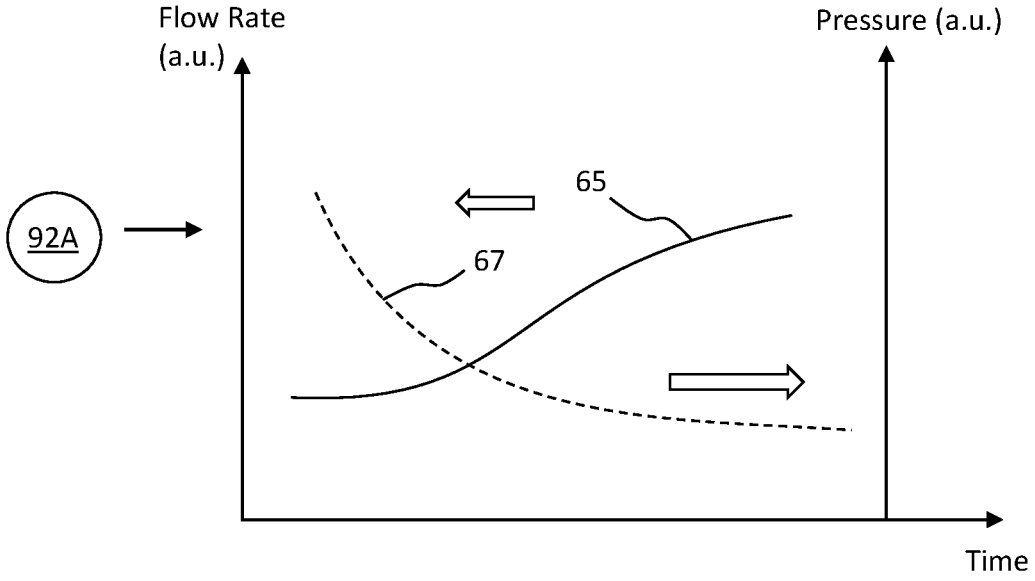
FIG. 1C are example plots of data indicating a leak within a hydraulically-actuated device, according to an embodiment.

FIG. 1C shows example plots of flow rate 65 and pressure drop 67 in chamber 34 as a function of time. Flow rate 65 is measured along flow rate axis (using arbitrary units a.u.) and pressure drop 67 is measured along pressure axis (using arbitrary units a.u.). In an example embodiment, an increase of flow rate 67 indicates a pressure drop in chamber 34 due to a leak in hydraulically-actuated device 14. In an example implementation, flow rate 67 is measured by sensor 92A. In some cases, changes in pressure in conduit 46 may also indicate a leak in hydraulically-actuated device 14.

Figure 1D:
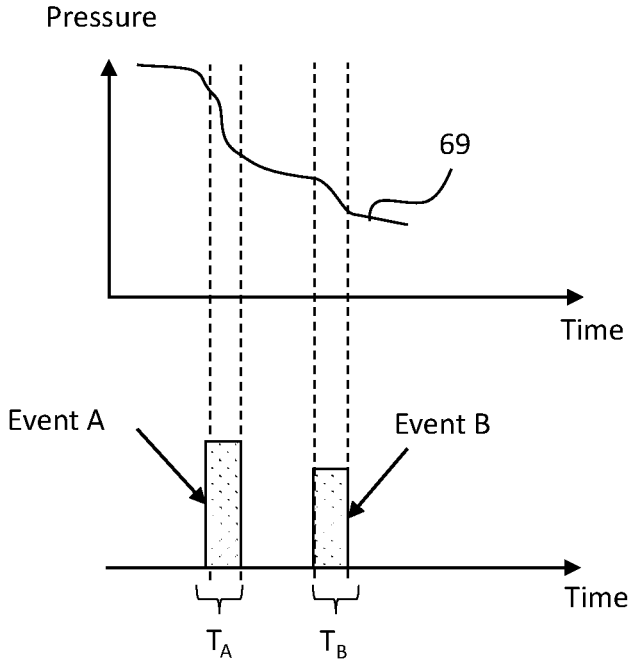
FIG. 1D is a correlation of data, indicating a leak within a hydraulically-actuated device, with events associated with operating or servicing BOP, according to an embodiment.

In some cases, amount of a fluid leaked from housing 22 may be associated with various events during an operation or servicing of the BOP. For example, leak may be increased when piston 30 moves relative to housing 22. For example, when piston 30 moves from left side of housing 22 to right side of housing 22, chamber 34 may increase and chamber 38 may decrease, thus affecting the characteristics of a leak. In an example implementation, the amount of fluid leaking from housing 22 increases or decreases due to a motion of piston 30 (e.g., due to a rate of motion of piston 30). In some cases, a leak may be increased or decreased due to other events associated with operating or servicing the BOP. Such events may include vibrations of the BOP, a movement of the BOP, an inclination of the BOP, presence of connections to BOP, and the like. FIG. 1D shows an example plot 69 of a determined drop of pressure in chamber 34 (the pressure drop in chamber 34 may be inferred from data of various sensors 92A-92J) as a function of time. The pressure drop may be correlated with various events, such as events A or B, shown in FIG. 1D, to establish which events may lead to increased leak in housing 22.

In various embodiments, a method for testing a hydraulically-actuated device is provided. As defined above the hydraulically-actuated device (e.g, device 14 or device 24) is configured to have a housing defining an interior volume and a piston disposed within the interior volume such that the piston divides the interior volume into a first chamber (chamber 34) and a second chamber (chamber 38), where the piston is movable relative to the housing to a maximum first position (position 30*a*, as shown in FIG. 1A) in response to pressure within the second chamber being higher than pressure within the first chamber and to a maximum second position (position 30*b*, as shown in FIG. 1A) in response to pressure within the first chamber being higher than pressure within the second chamber. In various implementations, the method includes steps of moving the piston from the maximum first position to the maximum second position by varying pressure within at least one of the first chamber or the second chamber such that pressure within the first chamber is higher than pressure within the second chamber. Further, the method may include measuring at least one parameter associated with sensors of system 20 which are not part of hydraulically-actuated device 24 (e.g., sensors 92A-92J) to determine a pressures withing first chamber 34 or/and second chamber 38 (or to determine changes of the pressures within first chamber 34 or/and second chamber 38), to establish if first chamber 34 or/and second chamber 38 contains a leak.

In some cases, when system 20 is configured to increase (or decrease) a pressure in first chamber 34 (or/and second chamber 38) by a target amount, a deviation from the target increase may be inferred from data obtained by sensors 92A-92J to infer about possible leak in one of first chamber 34 or second chamber 38. For example, if system 20 is configured to increase pressure in first chamber 34 by a first target amount $\Delta P_1(t)$ (the increase in the pressure may be a function of time) and decrease pressure in second chamber 38 by a second target amount $\Delta P_2(t)$ (the decrease in the pressure may be a function of time), the error $\in_1(t)=\Delta P_1(t)_{target}-\Delta P_1(t)_{measured}$ of actual increase in pressure relative to the target increase in pressure can be used for determining the leak in chamber 34 (or leaks between chambers 34 and 38 due to a fault in piston 30 separating chamber 34 and chamber 38). Additionally, or alternatively, the error $\in_2(t)=\Delta P_2(t)_{target}-\Delta P_2(t)_{measured}$ of actual decrease in pressure relative to the target decrease in pressure can be used for determining the leak in chamber 38 (or leaks associated with piston 30 separating chamber 34 and chamber 38).

Similarly, if system 20 is configured to decrease pressure in first chamber 34 by a first target amount $\Delta P_1(t)$ and increase pressure in second chamber 38 by a second target amount $\Delta P_2(t)$, the error $\in_1(t)=\Delta P_1(t)_{target}-\Delta P_1(t)_{measured}$ of actual decrease in pressure relative to the target decrease in pressure can be used for determining the leak in chamber 34, and the error $\in_2(t)=\Delta P_2(t)_{target}-\Delta P_2(t)_{measured}$ of actual increase in pressure relative to the target increase in pressure can be used for determining the leak in chamber 38. Above expressions may be generalized when decrease in pressures $\Delta P_1(t)$ or $\Delta P_2(t)$ is characterized by negative values and increase in pressures $\Delta P_1(t)$ or $\Delta P_2(t)$ is characterized by positive values.

In some cases, both chambers 34 and 38 may be configured to have a pressure increased or decreased, with errors $\in_1(t)$ and $\in_2(t)$ indicating leaks in respective chambers 34 and 38, as described above (or leaks associated with piston 30 separating chamber 34 and chamber 38).

In some cases, one of errors $\in_1(t)$ and $\in_2(t)$ may indicate whether a leak is due to a leak in housing 22 or due to leak in piston 30 separating chambers 34 and 38. For example, if pressure in chamber 38 is decreased by a target amount $\Delta P_2(t)_{target}$, but measured pressure $\Delta P_2(t)_{measured}>\Delta P_2(t)_{target}$, and there is no positive pressure difference of fluid across housing 22 (i.e., a fluid outside of housing 22 is not at a higher pressure than the fluid in any one of chambers 34 or 38) the leak in piston 30 may be determined (i.e., that piston 30 does not water-tightly separates chamber 34 and 38). In various cases, when piston 30 is allowed to freely move within housing 22, steady state pressures within chambers 34 and 38 may be the same, however transient pressures in chambers 34 and 38 (while piston 30 is in motion) may be different, and changes in these transient pressures relative to target transient pressure values may indicate a leak in housing 22 or piston 30. Such changes in transient pressure values may be determined indirectly via sensors 92A-92J as described above.

Furthermore, in some cases, a pressure in chamber 34 (herein, for brevity referred to as P34) may be the same as pressure in chamber 38 (herein, for brevity referred to as P38). Thus, P34=P38=P. For a given position of piston 30 within housing 22, pressures P34 and P38 may be increased by a target amount ΔP, and a time decrease in ΔP may be used to determine a leak within housing 22. By moving piston 30 to different locations and repeating measurements for time decrease in ΔP, a location of the leak may be established.

Alternatively, piston 30 may be configured to be fixed in place (via any suitable means, such as an auxiliary device being an external mechanism for moving piston 30) and pressure difference P34−P38 may be used to determine the leak due to seals of piston 30. In some cases, the auxiliary device may be configured to provide a prescribed motion for piston 30 regardless of pressures P34 and P38. For instance, auxiliary device may be a mechanical arm configured to move piston 30 without altering pressures P34 and P38 (e.g., the mechanical arm may be sealed relative to housing 22).

Figure 1E:
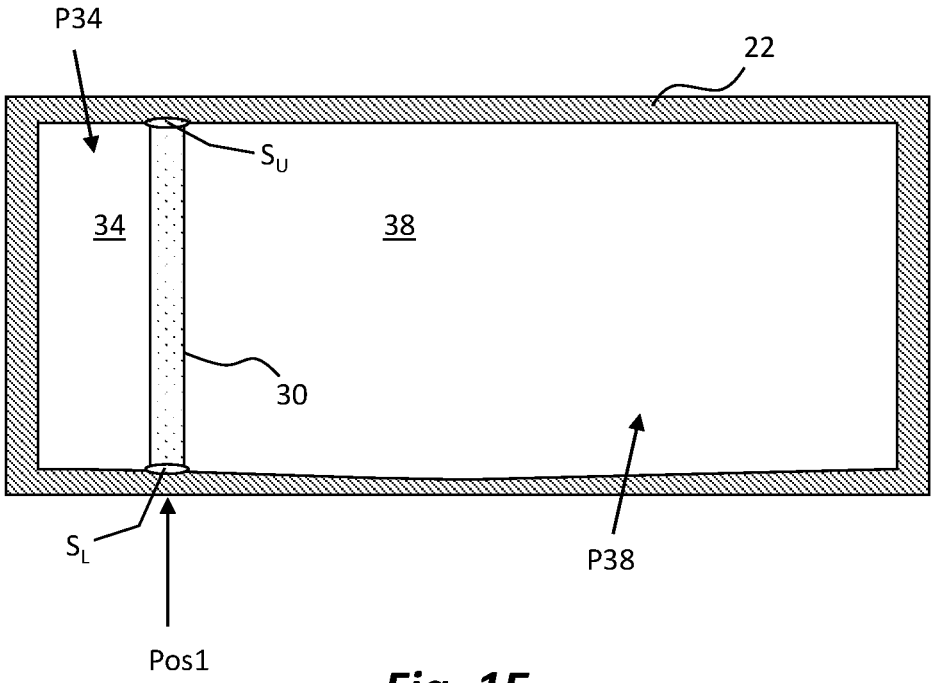
FIGS. 1E and 1F show a piston located at different positions within a hydraulically-actuated device, according to an embodiment.
Figure 1F:
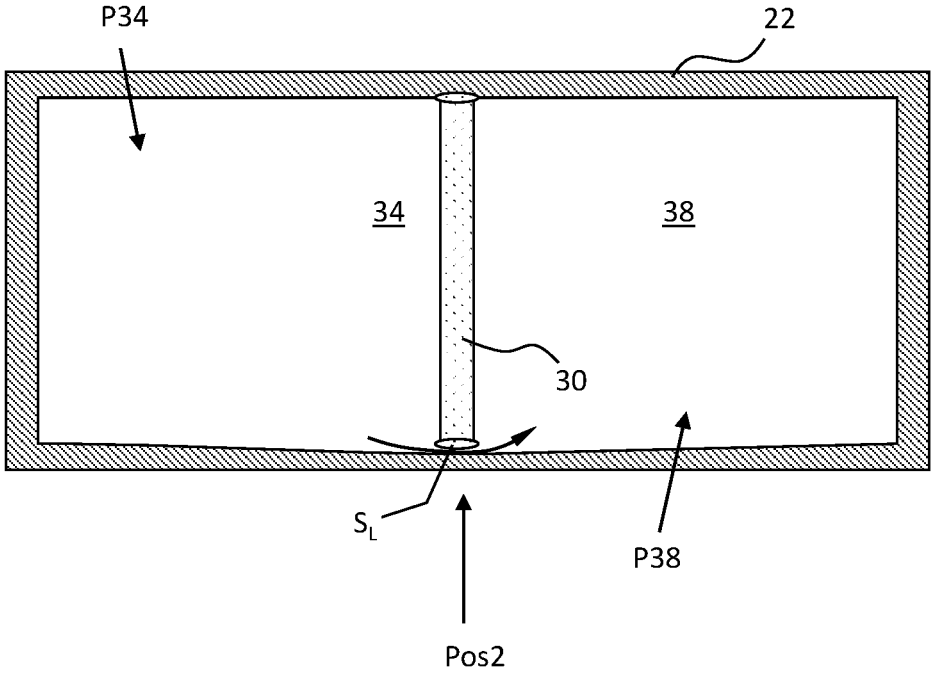

In an example embodiment, FIG. 1E shows piston 30 in a first position (Pos1) with seals $S_U$ and $S_L$ providing a water-tight seal between piston 30 and housing 22 to prevent fluid from moving between chambers 34 and 38. FIG. 1F shows, on the other hand, that due to some unevenness in housing 22, piston 30 at a second position (Pos2) may not provide the same sealing characteristics as at position Pos1 and seal $S_L$ may allow a leak between chamber 34 and chamber 38. Such a leak may be detected by measuring changes in pressures P34 and P38, which may be indirectly inferred from data obtained from sensors 92A-92J.

Figure 2:
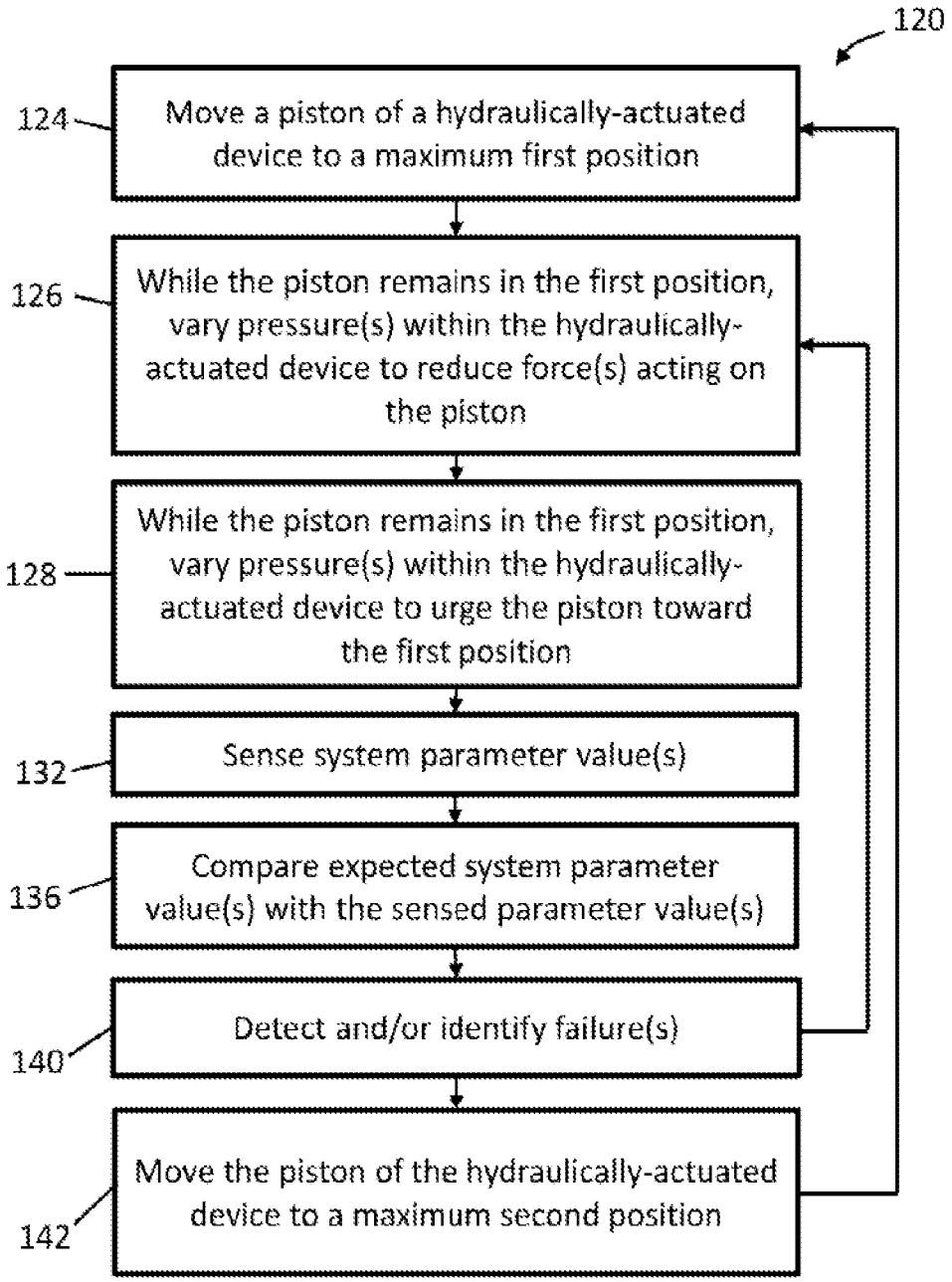
FIG. 2 depicts embodiments of the present methods for assessing the reliability of a hydraulically-actuated device, which may be implemented using the system of FIG. 1A.

Referring now to FIG. 2, shown is an embodiment 120 of the present methods for assessing the reliability of a hydraulically-actuated device (e.g., 14). In the embodiment shown, at step 124, a piston (e.g., 30) of a hydraulically-actuated device (e.g., 14) can be moved to a maximum first position (e.g., 30*a*). If the piston is already in the first position prior to step 124, step 124 may be omitted. To illustrate, in system 10, as shown in FIG. 1A, pump 68 can be actuated to increase pressure within second chamber 38 and/or decrease pressure within first chamber 34, thereby moving piston 30 to the first position.

At step 126, in this embodiment, while the piston remains in the first position, pressure(s) within the hydraulically-actuated device can be varied to reduce force(s) acting on the piston. In system 10, to illustrate, pump 68 can be actuated to decrease pressure within second chamber 38 and/or increase pressure within first chamber 34 (e.g., thereby reducing a pressure differential between the first and second chambers). In the depicted embodiment, at step 128, while the piston remains in the first position, pressure(s) within the hydraulically-actuated device can be varied to urge, but not necessarily move, the piston toward the first position (e.g., the pressure(s) can be varied to generate or increase a force exerted on the piston in a direction from a maximum second position 30*b* toward the first position). To illustrate, in system 10, as shown in FIG. 1A, pump 68 can be actuated to increase pressure within second chamber 38 and/or decrease pressure within first chamber 34 (e.g., thereby increasing a pressure differential between the first and second chambers).

Step 128 may be performed such that a pressure within the hydraulically-actuated device (e.g., within second chamber 38) meets a threshold or target pressure, such as, for example, a maximum operating pressure of the hydraulically-actuated device (e.g., 3,000, 4,000, 5,000, or more psig for many ram-type BOPs). During step 128, once a pressure within the hydraulically-actuated device meets the threshold or target pressure, the hydraulically-actuated device may be isolated from a pressure source (e.g., pump 68), as in, for example, a pressure decay test, and/or the pressure source may be actuated to maintain the pressure within the hydraulically-actuated device at or proximate to the threshold or target pressure (e.g., using feedback from sensor(s) 92), as in, for example, a maintained pressure test. Step 128 may be performed for a (e.g., pre-determined), period of time, such as, for example, 15, 30, 45, or more seconds, 1, 2, 5, 10, 15, 20, 25, 30, or more minutes, and/or the like. Such a period of time may be selected based on, for example, a calculated or approximated period of time necessary to detect a (e.g., maximum acceptable) leak within the hydraulically-actuated device or a system (e.g., 10) associated therewith, which may be determined considering, for example, system components (e.g., a resolution of sensor(s) 92, controller 102, and/or the like), a hydraulic analysis of the system, and/or the like.

In the embodiment shown, steps 132, 136, and/or 140 may be performed concurrently with step 128. At step 132, in this embodiment, system (e.g., 10) parameter value(s) can be sensed (e.g., using sensor(s) 92). Such parameter(s) can be any suitable parameter(s), including any one or more of those described above with respect to sensor(s) 92. In the depicted embodiment, at steps 136 and 140, the sensed parameter value(s) can be compared to expected parameter value(s) to detect and/or identify fault(s). In method 120, such fault(s) may be communicated (e.g., by processor 106) to an above-sea interface.

To illustrate, in system 10, as shown in FIG. 1A, processor 106 may compare sensed parameter value(s) to corresponding expected parameter value(s), such as for example, a known, minimum, maximum, calculated, commanded, and/or historical pressure, flow rate, temperature, and/or the like of hydraulic fluid within system 10, position, velocity, and/or acceleration of piston 30 relative to housing 22, speed of motor 82 and/or pump 68, torque output by the motor, voltage and/or current supplied to the motor, and/or the like. Processor 106 may be configured to detect and/or identify a fault if, for example, difference(s) between sensed and expected parameter value(s) exceed a threshold (e.g., the sensed and expected parameter value(s) differ by 1, 5, 10, 15, 20% or more), a time rate of change of a sensed parameter value is below or exceeds a threshold, a sensed parameter value is below a minimum expected parameter value or exceeds a maximum expected parameter value, and/or the like.

For example, and particularly when implementing a pressure-decay test, processor 106 may compare a sensed pressure within system 10, as shown in FIG. 1A, (e.g., within pump 68, hydraulically-actuated device 14, first communication path 46, second communication path 50, fluid reservoir 64, and/or the like) to an expected pressure within the system, and/or the like, and, if difference(s) between the sensed value(s) and the expected value(s) exceed a threshold, a fault, such as a leak within the system, may be detected and/or identified. For further example, and particularly when implementing a maintained pressure test, processor 106 may compare a sensed speed of motor 82 and/or pump 68 to an expected speed of the motor and/or pump, a sensed voltage and/or current supplied to the motor to an expected voltage and/or current supplied to the motor, and/or the like, and, if difference(s) between the sensed value(s) and the expected value(s) exceed a threshold, a fault, such a leak within the system, may be detected or identified. For yet further example, processor 106 may be configured to compare a sensed voltage and/or current supplied by battery 86 to an expected voltage and/or current supplied by the battery, and, if difference(s) between the sensed value(s) and the expected value(s) exceed a threshold, a fault, such as a fault associated with the battery, may be detected or identified (e.g., as in a battery load test).

In the depicted embodiment, steps 126-140 can be repeated any suitable number of times, and such repetition can occur at any suitable interval (e.g., 2, 4, 6, 8, 10, 12, or more hours, 1, 2, 3, 4, 5, 6, 7, 8, 9, 10, or more days, and/or the like). In these ways and others, method 120, and particularly steps 126-140, may provide for testing of a system (e.g., 10), without requiring full actuation of a hydraulically-actuated device (e.g., 14) (e.g., movement of a piston 30 to each of a maximum first position 30*a* and a maximum second position 30*b*). For example, in a system (e.g., 10) where a hydraulically-actuated device (e.g., 14) is a component of a BOP (e.g., 18), method 120, and particularly steps 126-140, may provide for testing of the system without requiring closing of the BOP.

At step 142, in the embodiment shown, the piston of the hydraulically-actuated device can be moved to a maximum second position (e.g., 30*b*). To illustrate, in system 10, pump 68 can be actuated to increase pressure within first chamber 34 and/or decrease pressure within second chamber 38, thereby moving piston 30 to the second position. During step 142, system parameter value(s) can be sensed, compared to expected system parameter value(s), and fault(s) can be identified and/or detected in a same or substantially similar fashion to as described above for steps 132, 136, and 140. In this embodiment, method 120 can be repeated any suitable number of times, and such repetition can occur at any suitable interval (e.g., 1, 2, 3, 4, 5, 6, 7, 8, 9, 10, 15, 20, 25, 30, or more days, and/or the like). Method 120 may be performed manually (e.g., via commands from an above-sea interface) and/or automatically (e.g., implemented via processor 106). For example, in some embodiments, steps 126-140 may be performed automatically, and step 142 may be performed manually.

Figure 3:
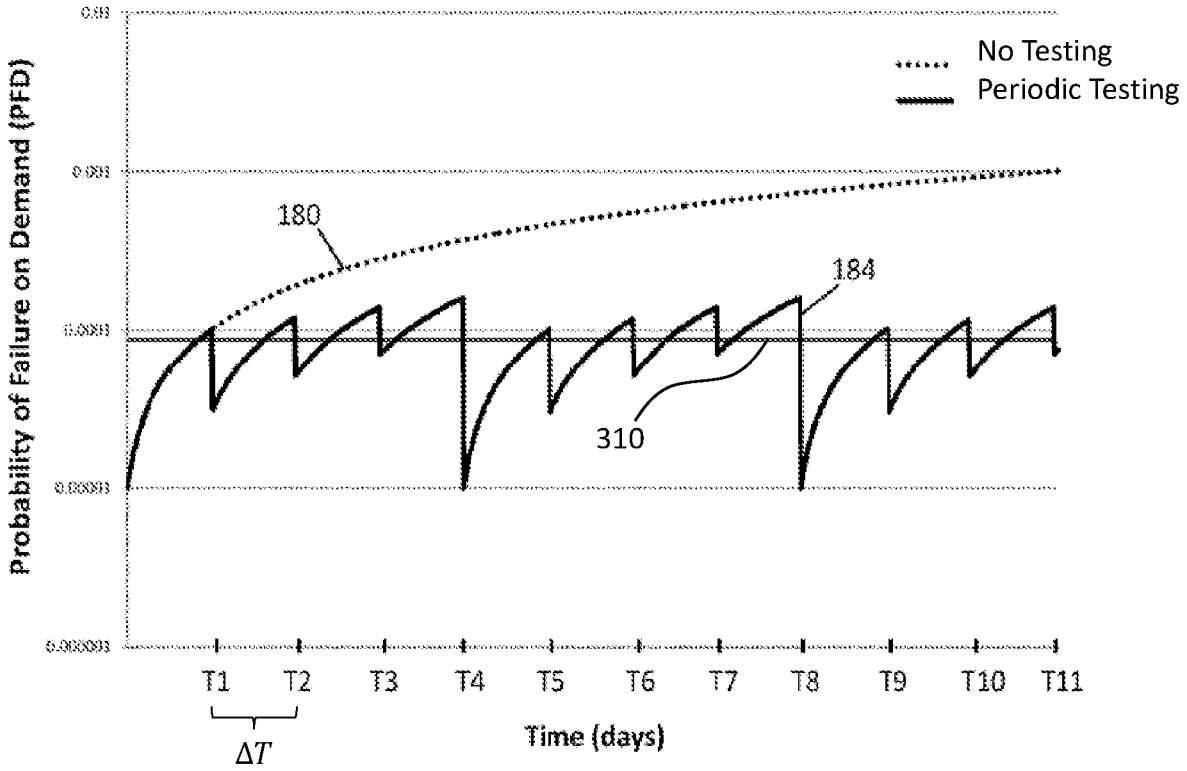
FIG. 3 is a graphical representation of PFD versus time for a system, such as the system of FIG. 1A, with and without implementing embodiments of the present methods, such as the methods of FIG. 2.

FIG. 3 is a graphical representation of a probability of failure on demand (PFD) versus time for a system (e.g., 10), with and without implementing embodiments (e.g., 120) of the present methods. Curve 180 represents PFD of system 10 without implementing embodiments (e.g., 120) of the present methods. As shown, the PFD increases over time due to, for example, growing uncertainty regarding the operability of system 10. Curve 184 represents PFD of system 10 with implementing embodiments (e.g., 120) of the present methods. Reductions in the PFD at times T1, T2, T3 can be attributed, at least in part, to steps 126-140 of method 120, and the reduction in the PFD at time T4 can be attributed, at least in part, to step 142. In an example embodiment, time intervals ΔT, as shown in FIG. 3, may be selected to result in PFD being smaller than a target value (indicated by a line 310 in FIG. 3).

Figure 4:
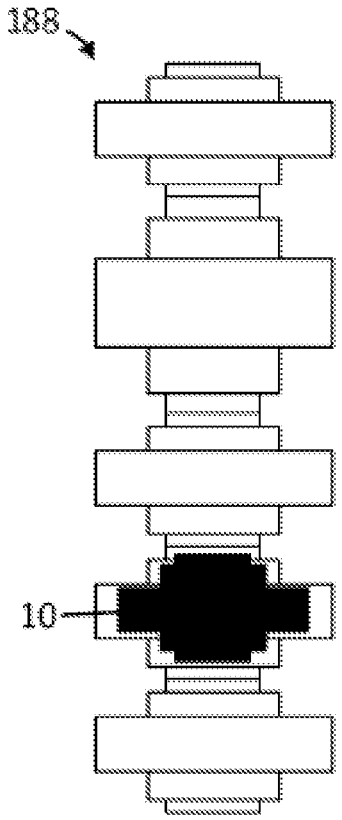
FIGS. 4 and 5 are schematics of a BOP stack including one embodiment of the present systems coupled to the BOP stack in a first position and a second position, respectively.
Figure 5:
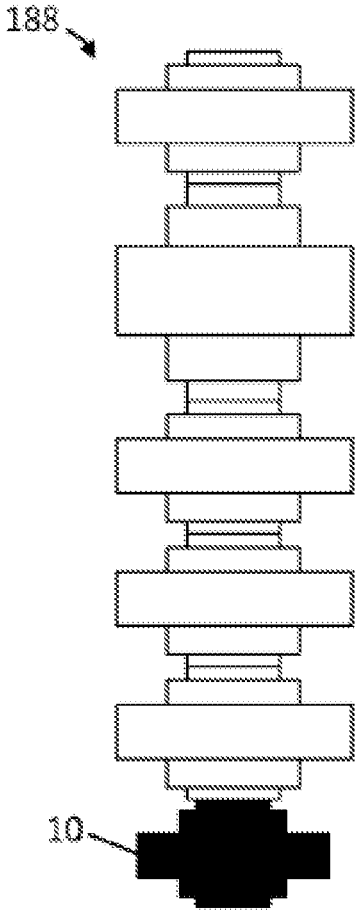

As shown in FIGS. 4 and 5, system 10 may be integrated with an existing BOP stack 188, in some instances, without affecting the operation of other systems of the BOP stack. Provided for illustrative purposes, FIG. 4 depicts such a configuration in which system 10 replaces an existing BOP of BOP stack 188, and FIG. 5 depicts a configuration in which system 10 is coupled to a wellhead end of BOP stack 188.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A method for testing a hydraulically-actuated device having a housing defining an interior volume and a piston disposed within the interior volume such that the piston divides the interior volume into a first chamber and a second chamber, where the piston is movable relative to the housing to a maximum first position in response to pressure within the second chamber being higher than pressure within the first chamber and to a maximum second position in response to pressure within the first chamber being higher than pressure within the second chamber, the method comprising steps:

(1) moving the piston from the maximum first position to the maximum second position by varying pressure within at least one of the first chamber or the second chamber such that pressure within the first chamber is higher than pressure within the second chamber;

(2) measuring at least one parameter measured by a sensor located outside of the hydraulically-actuated device to determine changes in the pressure within the first or the second chamber during a period of time to detect a leak within the hydraulically-actuated device or a system associated therewith; and (3) calculating a probability of failure (PFD) versus time for the hydraulically-actuated device or the system associated therewith.

2. The method of claim 1, where the hydraulically-actuated device contains a hydraulic fluid and wherein the at least one parameter includes at least one of:

a pressure of the hydraulic fluid within a conduit fluidly connected to the hydraulically-actuated device;

a flowrate of the hydraulic fluid within the conduit; or a temperature of the hydraulic fluid within the conduit.

3. The method of claim 1, wherein the moving of the piston is performed by actuating a pump.

4. The method of claim 3, wherein the actuating the pump includes actuating a motor that is coupled to the pump, the motor being an electric motor, and the at least one parameter includes at least one of:

a speed of the pump;

a speed of the motor;

a torque output by the motor;

a voltage supplied to the motor;

a current supplied to the motor; or a power output by the motor.

5. The method of claim 1, wherein the moving of the piston is further facilitated by an auxiliary device.

6. The method of claim 1, further comprising:

comparing the at least one parameter to an expected parameter value; and determining if a difference between the at least one parameter and the expected parameter value exceeds a threshold.

7. The method of claim 1, where the hydraulically-actuated device contains a hydraulic fluid and the hydraulically-actuated device is coupled to a blowout preventer (BOP) stack, and the hydraulic fluid includes at least one of an oil-based fluid, sea water, desalinated water, treated water, or water-glycol.

8. The method of claim 1, where the hydraulically-actuated device contains a hydraulic fluid, the method further comprising:

transferring the hydraulic fluid at least one of to or from the hydraulically-actuated device via an access port fluidically coupled to a remotely-operated underwater vehicle (ROV).

9. The method of claim 1, wherein a difference between first pressure in the first chamber and second pressure in the second chamber is selected to be a maximum operating pressure difference of the hydraulically-actuated device.

10. The method of claim 1, wherein a maximum pressure in the first chamber is selected to be at a target pressure.

11. The method of claim 10, wherein the target pressure is about a maximum operating pressure of the hydraulically-actuated device.

12. The method of claim 11, wherein the maximum operating pressure is in a range of 3000-5000 psig.

13. A method for testing a hydraulically-actuated device having a housing defining an interior volume and a piston disposed within the interior volume such that the piston divides the interior volume into a first chamber and a second chamber, where the piston is movable relative to the housing, the method comprising steps:

(1) moving the piston to a first position;

(2) while the piston remains in the first position, increasing first pressure within the first chamber and decreasing second pressure within the second chamber to meet a target pressure differential;

(3) measuring at least one parameter measured by a sensor located outside of the hydraulically-actuated device to determine changes in one of the first or the second pressure during a period of time to detect a leak within the hydraulically-actuated device or a system associated therewith.

14. The method of claim 13, wherein the piston is fixed in a first position via an auxiliary device.

15. The method of claim 14, wherein steps (1)-(3) are repeated for another position that is different than the first position.

16. The method of claim 13, further comprising: calculating a probability of failure (PFD) versus time for the hydraulically-actuated device or the system associated therewith, and wherein a time elapsed between testing the hydraulically-actuated device is selected such that PFD is at about or lower than a target value.

17. The method of claim 13, wherein a maximum pressure in the first chamber is selected to be at a maximum operating pressure of the hydraulically-actuated device.

18. The method of claim 13, wherein a maximum pressure in the second chamber is selected to be at a maximum operating pressure of the hydraulically-actuated device.

19. The method of claim 13, wherein a difference between the first pressure and the second pressure is selected to be a maximum operating pressure difference of the hydraulically-actuated device.

20. A system comprising:

a hydraulically-actuated device including:

a housing defining an interior volume; and a piston disposed within the interior volume such that the piston divides the interior volume into a first chamber and a second chamber;

where the piston is movable relative to the housing to a maximum first position in response to pressure within the second chamber being greater than pressure within the first chamber and to a maximum second position in response to pressure within the first chamber being greater than pressure within the second chamber;

a hydraulic pump configured to vary pressure within at least one of the first chamber or the second chamber; and a processor configured to control the hydraulic pump to, while the piston is moving from the maximum first position in response to pressure within the second chamber being smaller than pressure within the first chamber, the processor further configured to obtain at least one parameter measured by a sensor located outside of the hydraulically-actuated device to determine changes in the pressure within the first or the second chamber during a period of time to detect a leak within the hydraulically-actuated device or a system associated therewith, the processor further configured to calculate a probability of failure (PFD) versus time for the hydraulically-actuated device or the system associated therewith.

21. The system of claim 20, configured such that:

rotating hydraulic pump in a first direction at least one of decreases pressure within the second chamber or increases pressure within the first chamber; and rotating hydraulic pump in a second direction that is opposite the first direction at least one of increases pressure within the second chamber or decreases pressure within the first chamber.

22. The system of claim 20, further comprising an accumulator disposed between the bidirectional hydraulic pump and the hydraulically-actuated device, the accumulator being configured to provide pressurized hydraulic fluid to the hydraulically-actuated device to vary pressure within at least one of the first chamber or the second chamber.

* * * * *